US007100843B2

(12) United States Patent
Boticki et al.

(10) Patent No.: US 7,100,843 B2
(45) Date of Patent: Sep. 5, 2006

(54) FOAM NOZZLE

(75) Inventors: John A. Boticki, Racine, WI (US); James L. Bournoville, Racine, WI (US); Christopher F. Lang, Burlington, WI (US); Curtis H. Hubmann, Racine, WI (US)

(73) Assignee: JohnsonDiversey, Inc., Sturtevant, WI (US)

( * ) Notice: Subject to any disclaimer, the term of this patent is extended or adjusted under 35 U.S.C. 154(b) by 0 days.

(21) Appl. No.: 10/605,133

(22) Filed: Sep. 10, 2003

(65) Prior Publication Data

US 2005/0051641 A1 Mar. 10, 2005

(51) Int. Cl.

| | |
|---|---|
| ***B05B 7/30*** | (2006.01) |
| ***B05B 1/26*** | (2006.01) |
| ***E03C 1/08*** | (2006.01) |
| *B05B 9/043* | (2006.01) |

(52) U.S. Cl. ..... 239/343; 239/428.5; 239/504; 222/383.1

(58) Field of Classification Search ..... 239/333, 239/343, 391, 428.5, 436, 493, 504; 222/383.1
See application file for complete search history.

(56) References Cited

U.S. PATENT DOCUMENTS

| | | | | |
|---|---|---|---|---|
| 2,717,614 A | | 9/1955 | Palivos | |
| 3,946,947 A | * | 3/1976 | Schneider | 239/401 |
| 3,964,689 A | | 6/1976 | Horvath, Jr. | |
| 4,350,298 A | | 9/1982 | Tada | 239/333 |
| 4,603,812 A | | 8/1986 | Stoesser et al. | |
| 4,730,775 A | * | 3/1988 | Maas | 239/120 |
| 4,883,227 A | * | 11/1989 | Maas | 239/120 |
| 5,417,371 A | | 5/1995 | Brackett | |
| 5,611,490 A | | 3/1997 | Barriac et al. | |
| 5,647,539 A | * | 7/1997 | Dobbs et al. | 239/504 |
| 6,036,112 A | | 3/2000 | Hunsicker | 239/333 |
| 6,164,565 A | | 12/2000 | Adee et al. | |

FOREIGN PATENT DOCUMENTS

| | | |
|---|---|---|
| WO | WO 90/03227 | 4/1990 |

* cited by examiner

*Primary Examiner*—David A. Scherbel
*Assistant Examiner*—Darren Gorman
(74) *Attorney, Agent, or Firm*—Neil E. Hamilton; James J. Sales; Renee J. Rymarz

(57) ABSTRACT

A foam producing nozzle for attachment to a spray nozzle which is readily attached and removed therefrom. The foam producing nozzle has air channels which do not lend themselves toward leaking. The dilution rate of the chemical concentrate is not affected by the foam producing nozzle.

4 Claims, 3 Drawing Sheets

FOAM NOZZLE

BACKGROUND OF INVENTION

The field of the invention is nozzles for dispensing chemical concentrates, and particularly a nozzle which can be attached to a spray nozzle and provide a foam.

Foam nozzles that attach to spray nozzles are well-known. These are described in U.S. Pat. Nos. 4,603,812; 5,611,490; 5,647,539; and 6,164,565.

U.S. Pat. Nos. 4,603,812; 5,611,490; and 6,164,565 utilize radial passages for introducing air into a foam nozzle. These have drawbacks in that water and foam can be expelled from the radial passages. Further, these nozzles are retained by a detent or locking arrangements which makes them very difficult to remove.

In U.S. Pat. No. 5,417,371, axially positioned air vent channels are employed. However, they do not introduce air upstream of the nozzle body 10.

In U.S. Pat. No. 3,964,689, a nozzle means is disclosed to provide foam from a hose-end dispenser device. While air is introduced upstream of a screen 68, this arrangement is not provided in a foam nozzle that attaches to a spray nozzle. Neither does the foam nozzle prevent leakage.

What is needed is a foam nozzle attachment for a spray nozzle which reduces the incidence of water or foam leaking from it. Also desirable is a foam nozzle attachment which is readily removed from a spray nozzle when it is no longer wished to be used. In addition, it would be advantageous to have a foam nozzle attachment which does not affect the dilution rate of the chemical concentrate being dispensed.

SUMMARY OF INVENTION

The present invention provides a foam nozzle for attachment to a spray nozzle which includes: a tubular member having one end portion constructed and arranged to fit over the spray nozzle. The tubular member receives a flow of aqueous chemical solution from an upstream to a downstream direction. A foam producing member is located in an opposing end portion. At least one air passageway extends into the tubular member and terminates a distance upstream from the foam producing member.

In a preferred embodiment, the foam producing member is defined by radially extending rib members and includes a centrally positioned wall portion with the rib members extending radially therefrom.

In one aspect, the air passages are four channel members which are spaced equidistantly from each other and communicate with a spacing of the tubular member from the spray nozzle.

In another aspect, the foam producing member is positioned inwardly from the opposing end portion.

In another preferred embodiment, the air passageway is at least one opening extending through the tubular member and a spacing of the tubular member from the spray nozzle.

A general object of the invention is to provide a foam nozzle for attachment to a spray nozzle which reduces the incidence of leaking water or foam.

Another object is a foam nozzle of the foregoing type which is readily removed from a spray type nozzle.

Still another object is a foam nozzle attachment which while efficiently producing foam does not adversely affect the dilution rate of a chemical concentrate.

DETAILED DESCRIPTION

Figure 1:
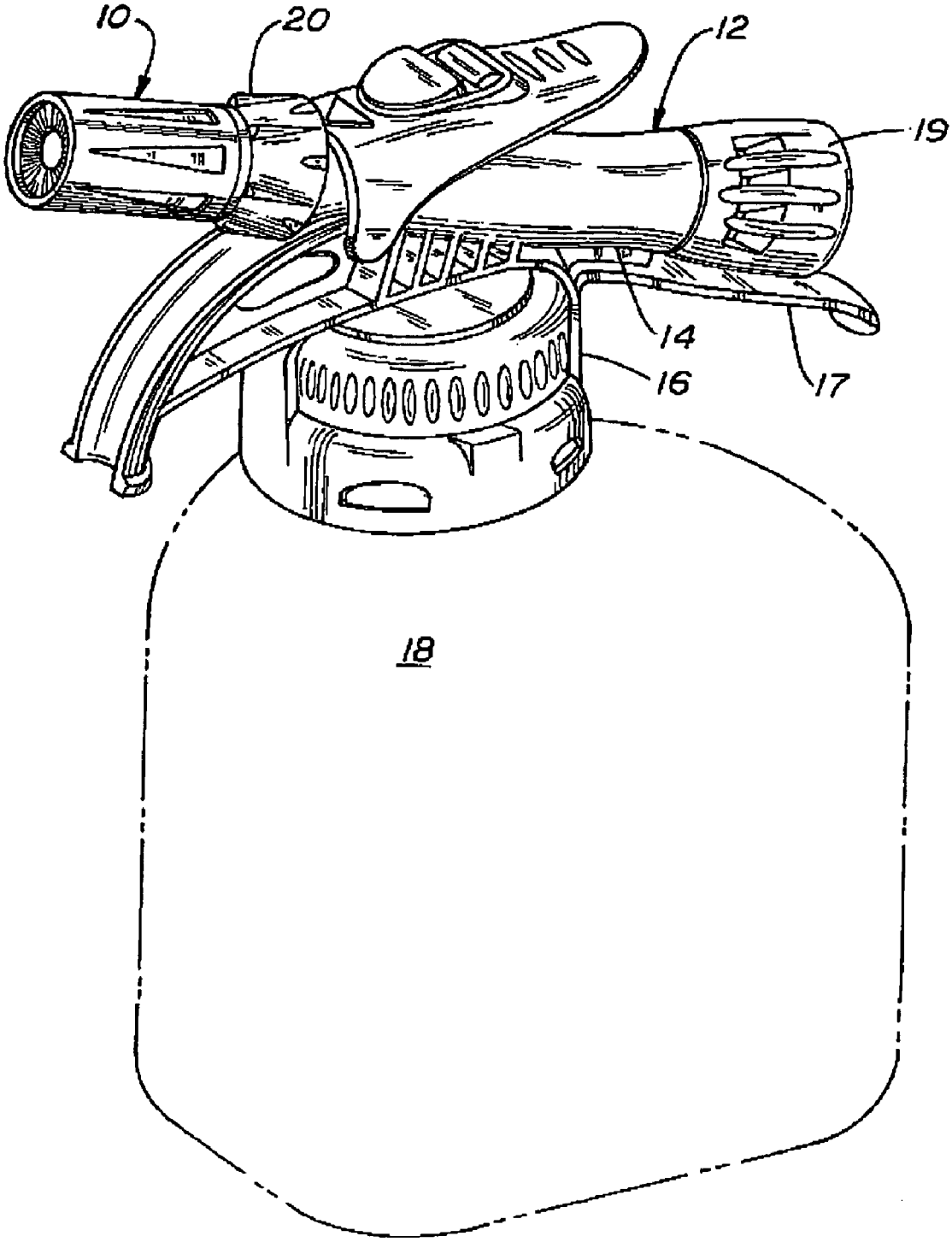
FIG. 1 is a perspective view of the foam nozzle attachment attached to a dispenser.

Referring to FIG. 1, the foam nozzle generally 10 is shown attached to a dispenser generally 12 which is described in a commonly owned patent application Ser. No. 09/956,294 filed Sep. 9, 2001 which teachings are incorporated herein. The dispenser has a body member 14 with a container connector 16 for connection to a container or bottle 18. A preferred connector system is more fully described in commonly owned patent application Ser. No. 10/037,569 filed Nov. 9, 2001 which teachings are incorporated herein. At one end of the body member 14 is a hose attachment 19 for supplying pressurized water to the dispenser which includes an eductor to siphon chemical concentrate from the container 18. A handle 17 is provided below attachment 19. At the other end there is a nozzle 20 for dispensing a mixed aqueous chemical solution.

Figure 3:
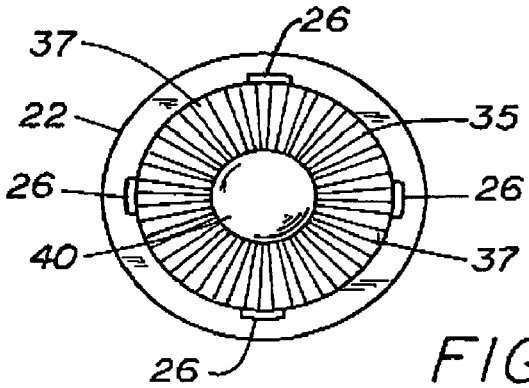
FIG. 3 is an end view of the foam nozzle attachment shown in FIG. 1.
Figure 4:
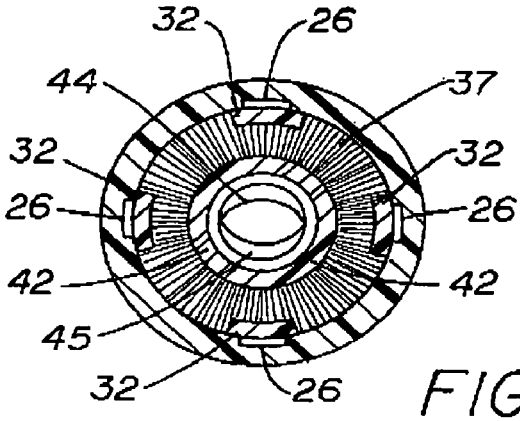
FIG. 4 is a sectional view taken along line 5—5 of FIG. 3.

As seen in FIGS. 3–4, the foam nozzle 10 has a tubular body section 22 which receives a flow of mixed aqueous chemical solution from an upstream to a downstream direction. An annual opening 24 is provided by the spacing between body member 22 and the inner portion 23 of spray nozzle 20. There are four internal grooves 26 which are equidistantly spaced inside body section 22. They are in fluid communication with the opening 24. These grooves 26 extend beyond the inner portion 28 of the nozzle 20 as shown at 30. The body member 22 is attached to the inner portion 23 of the spray nozzle 20 by a friction fit.

At the opposite end of body section 22, there is connected a foam producing member 35 having radially disposed and spaced ribs and a central deflector 40.

Figure 2:
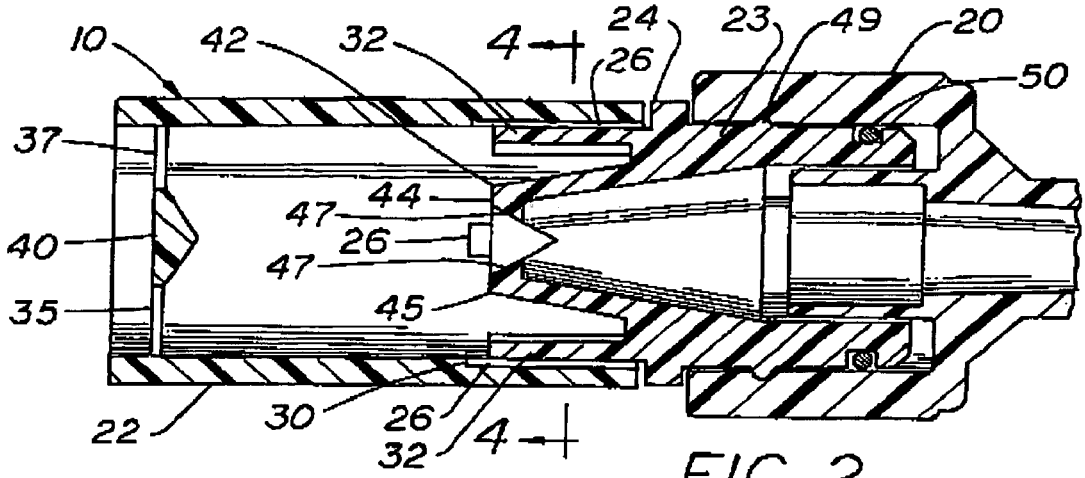
FIG. 2 is a cross-sectional view of the foam nozzle attachment shown in FIG. 1.

As seen in FIGS. 2 and 4, the inner portion 23 of nozzle member 20 has four equidistantly disposed projections 32 which fit inside body section 22 of foam nozzle 10. The inner portion 23 of nozzle member 20 includes a nozzle head 42 with two lips 44 and 45 having inwardly angled walls 47. It is connected to nozzle member 20 by the rib and groove arrangement 49 and seal 50.

Figure 5:
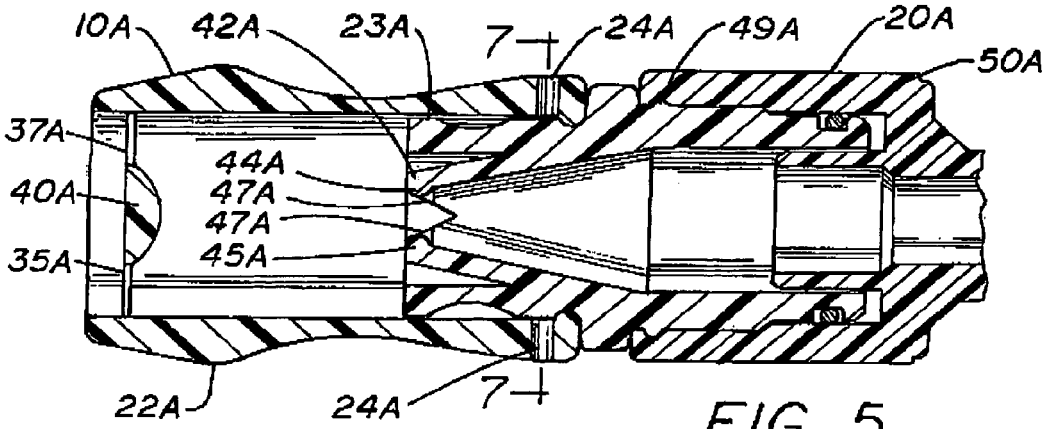
FIGS. 5, 6 and 7 are views similar to FIGS. 2, 3 and 4, respectively, showing another embodiment.
Figure 6:
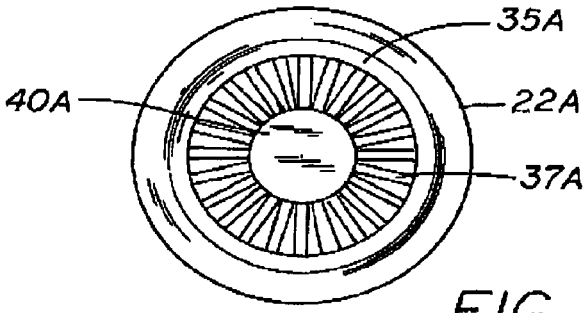
Figure 7:
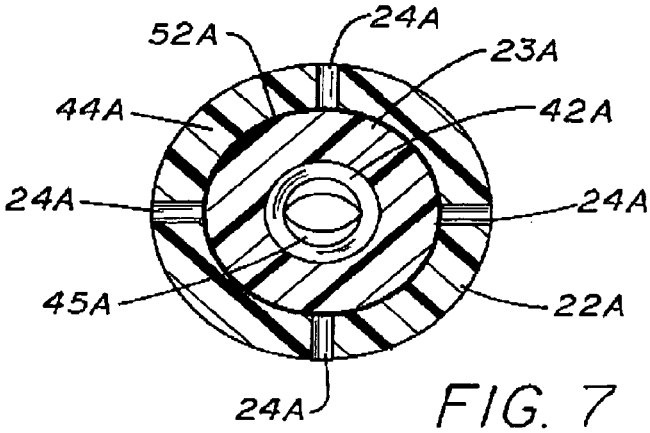

A preferred embodiment 10A is shown in FIGS. 5–7. The same reference numbers are employed to designate similar parts except they are indicated with the "A"0 suffix. The major difference between embodiments 10 and 10A is that there are no grooves 26 in embodiment 10A, which serve as air passageways. Further, in place of air opening gap 24, there are 4 equidistantly spaced holes 24A which introduce air into the inside of body section 22A. This is facilitated by the spacing of inner portion 23A from body section 22A to provide an annular passage 52A.

The important feature of both embodiments 10 and 10A is the introduction of air into the inside of body sections 22 and 22A, and upstream of the foam producing members 35 and 35A. This enhances foam production from the aqueous chemical solution exiting from the nozzle heads 42 and 42A in conjunction with the foam producing members 35 and 35A where the radial ribs 37, 37A provide a screen portion which increases foam by agitation. At the same time, deflectors 40 and 40A deflect back a portion of the foam to assure increased foam production. The indirect air passages such as the spacing 24 in combination with grooves or the air holes 24A in combination with annular passage 52A reduce the incidence of the aqueous solution leaking from the foam nozzle.

It will thus be seen that there is now provided a foam nozzle attachment 10 and 10A which is simple in construction yet can produce foam in an efficient manner. The foam nozzles 10 and 10A are easily retrofitted to a spray nozzle and can be utilized in conjunction with a wide variety of aqueous detergent and disinfectant solutions.

The preferred materials for producing foam nozzle members 20, 20A, body sections 22 and 22A and foam producing members 35 and 35A is polypropylene. However, other materials such as die cast metals and other injection molded plastics or elastomers could also be employed.

The foam producing members 35 has been described with a radial spoke arrangement. While this is preferred, other arrangements of spaced members such as screens of various configurations could be used. Radial ribs 37, 37A and deflectors 40 and 40A are illustrated as separate components. If desired, a stainless steel screen could be substituted such as a 100×100 mesh 316 stainless steel screen. However, the spoke arrangement offers the advantage of regular spacing for a consistent foam and a one piece design to eliminate secondary operations when the part is made. The only mandate is that there is sufficient impingement yet enough passage of the aqueous solutions to produce foam without affecting desired flow. All such and other modifications within the spirit of the invention are meant to be within its scope as defined by the appended claims.

The invention claimed is:

1. A foam nozzle for attachment to a spray nozzle comprising:

a tubular member having one end portion constructed and arranged to fit over the spray nozzle and to receive a flow of aqueous chemical solutions from an upstream to a downstream direction;

a foam producing member located in an opposing end portion; and at least one air passageway extending into the tubular member and terminating upstream from the foam producing member, the air passageway comprising at least one opening extending through the tubular member and a spacing of the tubular member from the spray nozzle, the air passageway constructed and arranged to extend over a portion of the spray nozzle, whereby the incidence of solutions leaking from the nozzle is reduced.

2. The foam nozzle as defined in claim 1 wherein there are four openings spaced equidistantly around the tubular member.

3. A combined spray and foam nozzle comprising:

a spray nozzle for attachment to a dispensing member;

a foam nozzle frictionally attached to the spray nozzle, the foam nozzle including:

a tubular member having one end portion constructed and arranged to fit over the spray nozzle and to receive a flow of aqueous chemical solution from an upstream to a downstream direction;

a foam producing member located in an opposing end portion; and at least one air passageway extending into the tubular member and terminating upstream from the Loam producing member, the air passageway comprising at least one opening extending through the tubular member and a spacing of the tubular member from the spray nozzle, the air passageway constructed and arranged to extend over a portion of the spray nozzle, whereby the incidence of solutions leaking from the nozzle is reduced.

4. The foam nozzle as defined in claim 3 wherein there are four openings spaced equidistantly around the tubular member.

* * * * *

UNITED STATES PATENT AND TRADEMARK OFFICE

CERTIFICATE OF CORRECTION

PATENT NO. : 7,100,843 B2
APPLICATION NO. : 10/605133
DATED : September 5, 2006
INVENTOR(S) : John A. Boticki et al.

It is certified that error appears in the above-identified patent and that said Letters Patent is hereby corrected as shown below:

Col. 4, Claim 3, Line 28
"Loam" should read --foam--

Signed and Sealed this

Fifth Day of December, 2006

JON W. DUDAS
*Director of the United States Patent and Trademark Office*